US005988760A

United States Patent [19]

Durup et al.

[11] Patent Number: 5,988,760

[45] Date of Patent: Nov. 23, 1999

[54] PROCESS FOR HOLLOWING OUT A CAVITY FORMED OF A PLURALITY OF SUB-CAVITIES IN A THIN LAYER OF SALT

[75] Inventors: Jean-Gérard Durup, Le Raincy; Guy Boris, Le Kremlin-Bicetre; Yvon Charnavel, Rosny-Sous-Bois, all of France

[73] Assignee: Gaz de France (G.D.F.) Service National, Paris, France

[21] Appl. No.: 08/928,506

[22] Filed: Sep. 12, 1997

[30] Foreign Application Priority Data

Sep. 30, 1996 [FR] France ..... 96 11898

[51] Int. Cl.[6] ..... E21B 43/28

[52] U.S. Cl. ..... 299/5; 166/50

[58] Field of Search ..... 299/4, 5; 405/55, 405/58; 166/50

[56] References Cited

U.S. PATENT DOCUMENTS

| | | | |
|---|---|---|---|
| 3,050,122 | 8/1962 | Huitt et al. | 166/55.8 |
| 3,510,167 | 5/1970 | Carmody | 299/4 |
| 4,339,008 | 7/1982 | Ford et al. | 175/272 |
| 4,386,665 | 6/1983 | Dellinger | 175/61 |
| 4,418,960 | 12/1983 | Higgins | 299/5 |
| 4,425,003 | 1/1984 | Huff | 299/5 |
| 4,858,689 | 8/1989 | Logan | 166/256 |
| 5,246,273 | 9/1993 | Rosar | 299/4 |

FOREIGN PATENT DOCUMENTS 95 10689 4/1995 WIPO .

*Primary Examiner*—George Suchfield
*Attorney, Agent, or Firm*—Rothwell, Figg, Ernst & Kurz

[57] ABSTRACT

A process for hollowing out a cavity, by dissolution, in a ground formation comprising at least one layer containing predominantly salt, the process including the steps of drilling at least one hole having a substantially horizontal section arranged at least in part in the salt layer, providing in the drilled hole(s) an injection pipe, an extraction pipe and a preliminary communication space connecting the injection pipe and the extraction pipe, injecting a solvent of the salt, into the communication space, through one end of the injection pipe forming an injection point, extracting, through the extraction pipe, the brine formed by the dissolution of the salt, in contact with the solvent, producing a plurality of preliminary sub-cavities in the salt layer, and producing a succession of channels, isolated from the layer, the succession of channels connecting the plurality of preliminary sub-cavities in a fluid manner two at a time in order to form an open circuit for circulation of the solvent, expending between a first sub-cavity and a last sub-cavity, the preliminary sub-cavities and the channels defining the preliminary communication space.

10 Claims, 4 Drawing Sheets

PROCESS FOR HOLLOWING OUT A CAVITY FORMED OF A PLURALITY OF SUB-CAVITIES IN A THIN LAYER OF SALT

BACKGROUND OF THE INVENTION

1. Field of the Invention

The subject of the invention is a process for hollowing out a cavity, by dissolution, in a ground formation comprising at least one layer containing predominantly salt to be dissolved.

2. Description of the Background Art

The invention aims more particularly to obtain, after hollowing out, a subterranean cavity permitting the storage of a fluid and especially of natural gas in a stratified layer of salt, the thickness of which is typically of the order of several tens of meters, and more particularly between 30 meters and 100 meters. The salt may consist especially of sodium chloride (NaCl) or potassium chloride (KCl), without this being restrictive.

The object of the invention is in particular to provide a solution which will be low in cost in relation to the volume of the cavity. To this end, the invention tends to improve the shape of the cavity obtained in order to adapt it to the shape of the layer of salt and thus increase its volume.

However, since the cavity is to be subjected, in use, to the storage of gas, it is necessary to control the spread of the dissolution process in order to obtain a final cavity having a mechanically stable form. Moreover, the cavity obtained must provide a satisfactory seal with respect to the external environment.

U.S. Pat. No. 5,246,273 and WO-A-95 10689 do in fact describe a process comprising the following steps:

- drilling at least one hole comprising a substantially horizontal section arranged at least in part in the salt layer,
- providing in the drilled hole(s) an injection pipe, an extraction pipe and a preliminary communication space connecting the injection pipe and the extraction pipe,
- injecting a solvent of the salt, into the communication space, through one end of the injection pipe forming an injection point,
- extracting, through the extraction pipe, the brine formed by the dissolution of the salt, in contact with the solvent.

However, the process described in WO-A-95 10689 is rather complex, since it requires the provision of different injection apertures, the dimensioning of which must be carried out accurately based on the evaluation of different parameters. Moreover, this solution raises the problem of reliability—behaviour over time—since the size of at least some of the apertures is likely to increase owing to wear in contact with the solvent and in other cases to decrease owing to the presence of insoluble elements in the salt layer.

The process described in U.S. Pat. No. 5,246,273 requires sophisticated equipment to control the injection of the solvent in a substantially horizontal plane. Moreover, the solution described in that document is not very well suited to cavities of several tens of meters in thickness and more than one hundred meters long. Finally, the cavity obtained does not guarantee mechanical stability and a satisfactory seal with respect to the external environment.

The document U.S. Pat. No. 3,510,167 discloses a process for improving the speed of dissolution of a layer of salt which consists in passing the solvent previously into another layer of salt in order to increase its density.

However, this process is remote from the invention. In fact, this process does not make it possible to control the shape of the cavity obtained. Furthermore, a plurality of separate cavities is obtained, and moreover these belong to separate layers of salt. The present invention itself aims to obtain a single cavity.

SUMMARY OF THE INVENTION

In order to solve the different problems mentioned above, the invention proposes that there be provided:

- a plurality of preliminary sub-cavities in the salt layer,
- a succession of channels isolated from the said layer to be dissolved containing salt, the channels connecting the sub-cavities in a fluid manner two at a time in order to form an open circuit for circulation of the solvent, extending between a first sub-cavity and a last sub-cavity, the preliminary sub-cavities and the channels defining the said preliminary communication space.

The final cavity will be produced from a succession of sub-cavities, the size of which, in particular the height (i.e. thickness), can be controlled individually. The shape of the cavity can thus be better adapted to the shape of the salt layer. The variations in thickness of the cavity may in particular be better controlled. Since this can be achieved without reaching the limits of the layer, the mechanical stability and the sealing of the cavity can be obtained by retaining a thickness of salt or brine all round.

The term height should be understood in the rest of the description in the sense of the elevation height, along the vertical of the site.

According to an advantageous characteristic, the invention proposes that the last sub-cavity be connected to the extraction pipe, and that the solvent be injected into each of the sub-cavities in succession. This solution is simple and makes it possible to dissolve the salt substantially only in one sub-cavity at a time. In fact, although the brine passes into all the sub-cavities separating the cavity into which the solvent is injected from the last sub-cavity, in practice, owing to its saturation with salt, dissolution occurs essentially only in the sub-cavity where the solvent is injected.

The invention also proposes different solutions for producing the channels. According to a first variant, the channels isolated from the salt are produced by arranging, in the drilled hole, casing sections which are impermeable to the solvent, and by guiding the brine in these casing sections. This solution takes longer to put into effect, but does not make it necessary to have available a layer which is stable with respect to the circulation of the brine (absence of dissolution, moderate erosion . . . ). When the hollowing out of the cavity by dissolution is completed, the seal between the cavity and the adjacent ground formation can be obtained by retaining a thickness of brine between the cavity and the adjacent ground formation.

Advantageously, in order to guide the brine in the casing sections, the following steps are carried out:

- drilling the hole,
- introducing a casing into the drilled hole thus obtained, into the layer of salt,
- arranging a sealing material (such as concrete) between the casing and the drilled hole, and
- eliminating the casing and the sealing material in specific areas in order to form the preliminary sub-cavities.

According to a second variant, these channels isolated from the layer containing the salt to be dissolved are produced by drilling in a ground formation adjacent to the said layer of salt and containing little or no salt soluble by the solvent. This solution offers rapid execution and requires little equipment.

BRIEF DESCRIPTION OF THE DRAWINGS

The invention will be revealed even more clearly by the description which follows, provided with reference to the accompanying drawings, in which.

For the sake of greater legibility of the drawings, the respective proportions of the different elements have not been strictly adhered to.

DETAILED DESCRIPTION OF THE PREFERRED EMBODIMENTS

Figure 1:
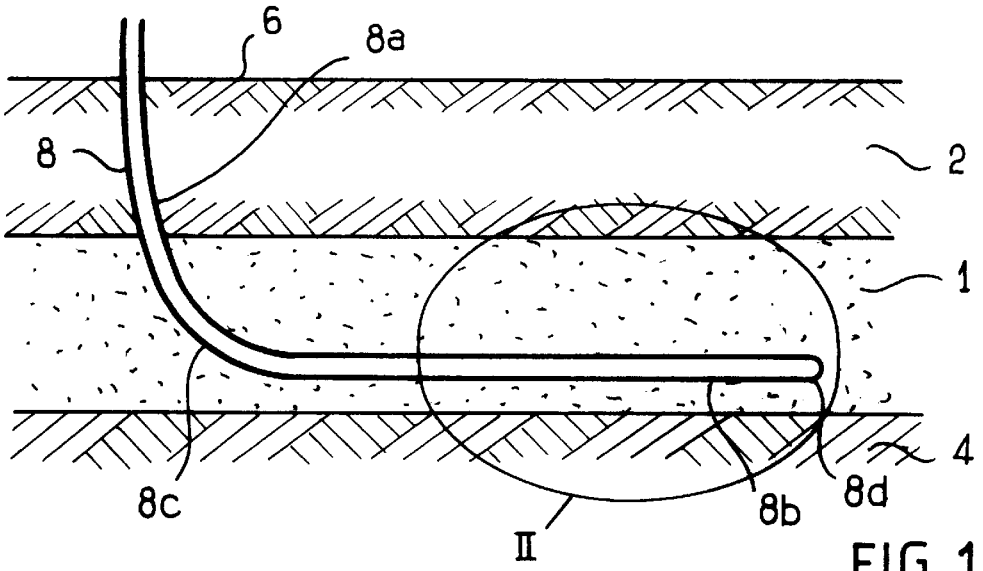
FIG. 1 shows in section a ground formation comprising a layer of salt, during a first step of the process and according to a first variant.

FIG. 1 illustrates a ground formation comprising a layer 1 containing predominantly salt. This layer lies between two other mineral layers 2, 4 contained in the soil and containing little or no salt.

A drilled hole 8 has been produced by drilling means (not shown) regarded as being known. The drilled hole comprises a substantially vertical section 8*a* extending from ground level 6 to the layer of salt 1, a substantially horizontal elongate section 8*b* extending in the salt layer 1 to one end 8*d*, and a curved section 8*c* connecting the vertical section 8*a* and the horizontal section 8*b*.

Figure 2:
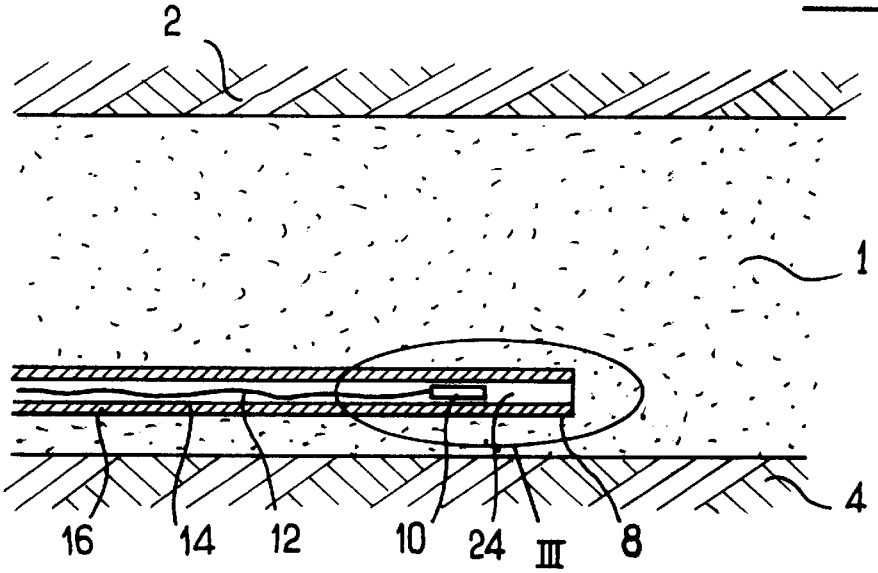
FIG. 2 is an enlarged view of the area having the reference II in FIG. 1, during a second step of the process, according to the first variant.

As illustrated in FIG. 2, an elongate casing 14 having a channel 24 on the inside is introduced into the drilled hole 8 and especially into its horizontal section 8*b*. A sealing material 16, in this case comprising cement, is arranged by injection between the casing 14 and the drilled hole 8. This material 16 provides a seal between the casing 14 and the salt layer 1.

A cutting apparatus 10 is then introduced into the casing 14. Such an apparatus is marketed in particular under the reference MILL MASTER and the trademark SERVCO (registered trademark). The cutting apparatus is connected to the surface 6 by a drilling rod 12 allowing the apparatus 10, in particular, to be placed in position, to be guided along the casing, and to be supplied with power and fluid.

Figure 3:
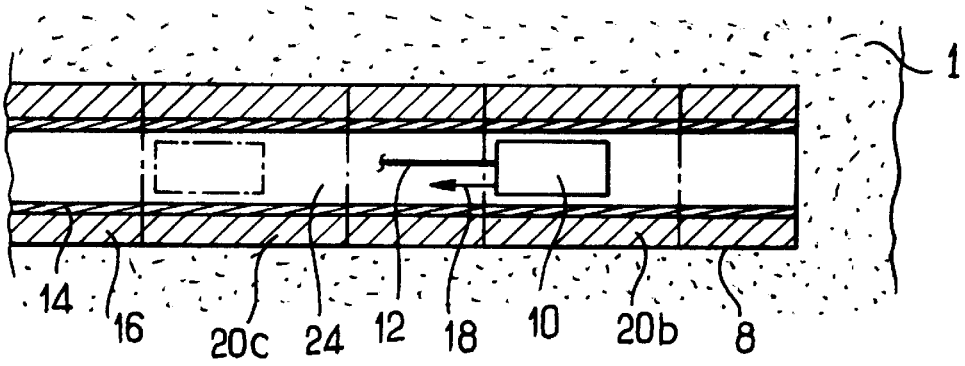
FIG. 3 is an even more enlarged view of the area having the reference III in FIG. 2.

As illustrated in FIG. 3, the apparatus 10 is capable of eliminating from place to place, in this case by abrasion in specific areas 20*b*, 20*c*, the casing 14 and also the thickness of sealing material 16, until it comes into contact with the salt layer 1. The apparatus is displaced along the inside of the casing from one specific area to another inside the casing 14 as indicated by the arrow 18. The sealing material could alternatively be abraded by means of an apparatus marketed under the trademark SERVCO (registered trademark) and the reference Rock Type Undereamer.

Figure 4:
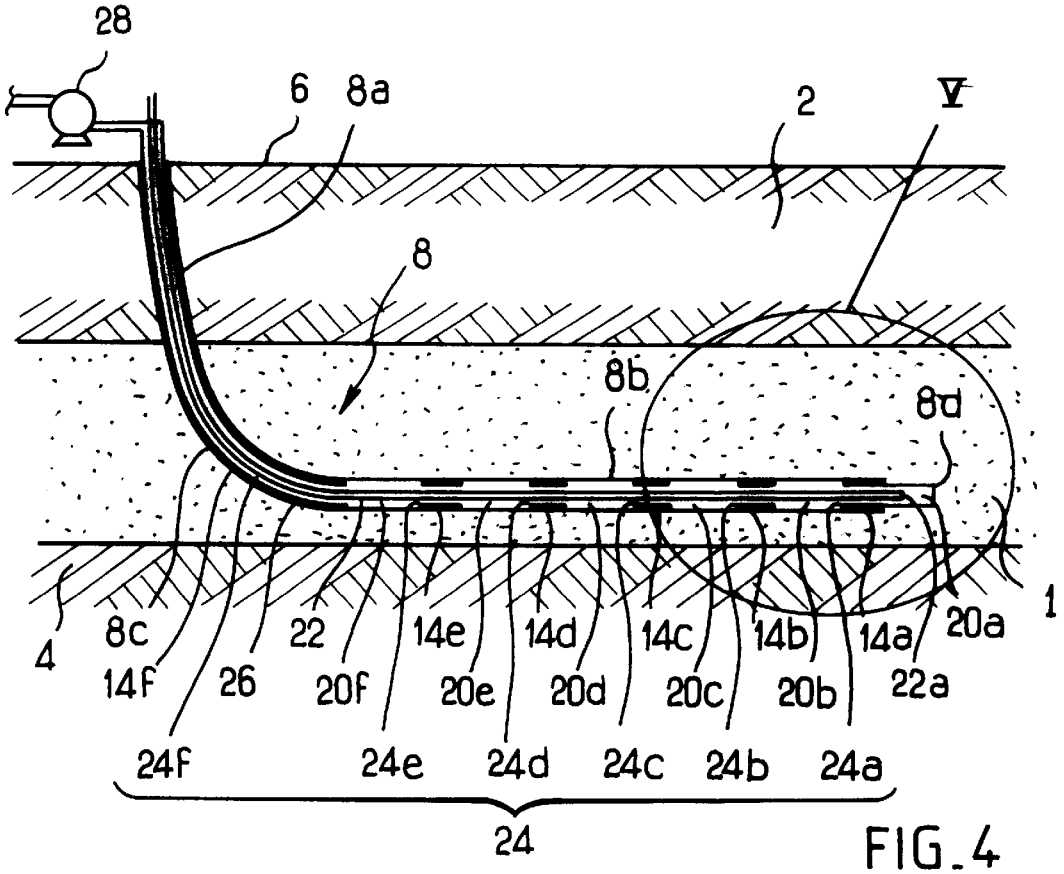
FIG. 4 shows in section the ground formation comprising the layer of salt, during a third step of the process and according to the first variant.
Figure 5:
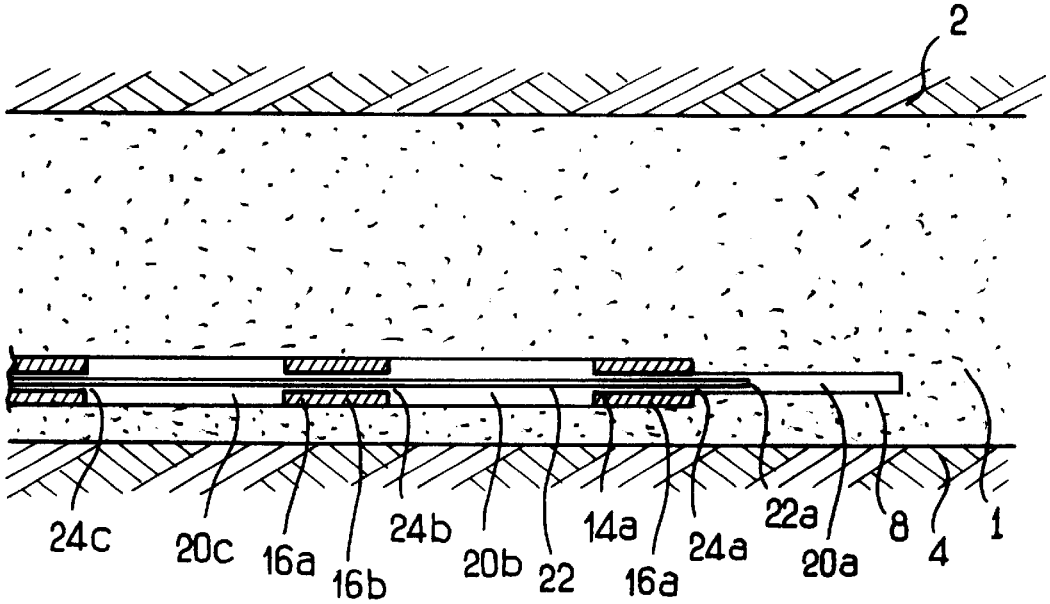
FIG. 5 is an enlarged view of the area having the reference V in FIG. 4.

The elimination of the casing 14 and of the sealing material 16 in different areas creates the same number of preliminary sub-cavities 20*b*, 20*c*, 20*d*, 20*e*, 20*f*, all these sub-cavities belonging to the same layer of salt 1, as illustrated in FIGS. 4 and 5. The drilled hole is then extended at its end 8*d* by the drilling means introduced into the casing 14 in order to form a sub-cavity 20*a*.

In these FIGS. 4 and 5, the sub-cavities 20*a*, 20*b*, 20*c*, 20*d*, 20*e*, 20*f* are connected two at a time between a first sub-cavity 20*a* and a last sub-cavity 20*f* by channels 24*a*, 24*b*, 24*c*, 24*d*, 24*e* provided inside the casing sections 14*a*, 14*b*, 14*c*, 14*d*, 14*e* remaining after abrasion of the casing 14 in the different specific areas. A channel 24*f* provided inside the casing 14 connects the cavity 20*f* to the surface of the ground 6.

A tube 22 is introduced concentrically in the channel 24 of the casing, advanced into the sub-cavity 20*a* by passing through each of the sub-cavities 20*f*, 20*e*, 20*d*, 20*c*, 20*b* and by passing into each of the channels 24*f*, 24*e*, 24*d*, 24*c*, 24*b*, 24*a*. The tube 22 has an outside diameter markedly smaller than the inside diameter of the casing 14 in order to permit fluid circulation between the tube 22 and the casing 14 in the channels 24*a*, 24*b*, 24*c*, 24*d*, 24*e*, 24*f*.

The tube 22 has an aperture 22*a* forming an injection point and intended to permit the injection of a solvent of the salt, in this case water, into the different sub-cavities 20*a*, 20*b*, 20*c*, 20*d*, 20*e*, 20*f*.

As illustrated in FIG. 4, an injection pump 28 pressurizes the water injected by the tube 22 forming an injection pipe. The water injected through the injection point 22*a* into the last sub-cavity 20*a* hollows out the layer of salt 1 by dissolving the salt in this sub-cavity 20*a*. The brine formed by the dissolution of the salt in the water flows in a communication space formed by the channels 24*a*, 24*b*, 24*c*, 24*d*, 24*e* and the sub-cavities 20*b*, 20*c*, 20*d*, 20*e*, 20*f*. This pressurized brine is extracted from the sub-cavity 20*f* through the channel 24*f* forming an extraction channel.

The communication space constitutes an open circuit for circulation of the water in the form of brine. Between two sub-cavities, the water is guided in a channel which isolates it from the layer of salt 1, the casing and the sealing material being watertight.

Figure 6:
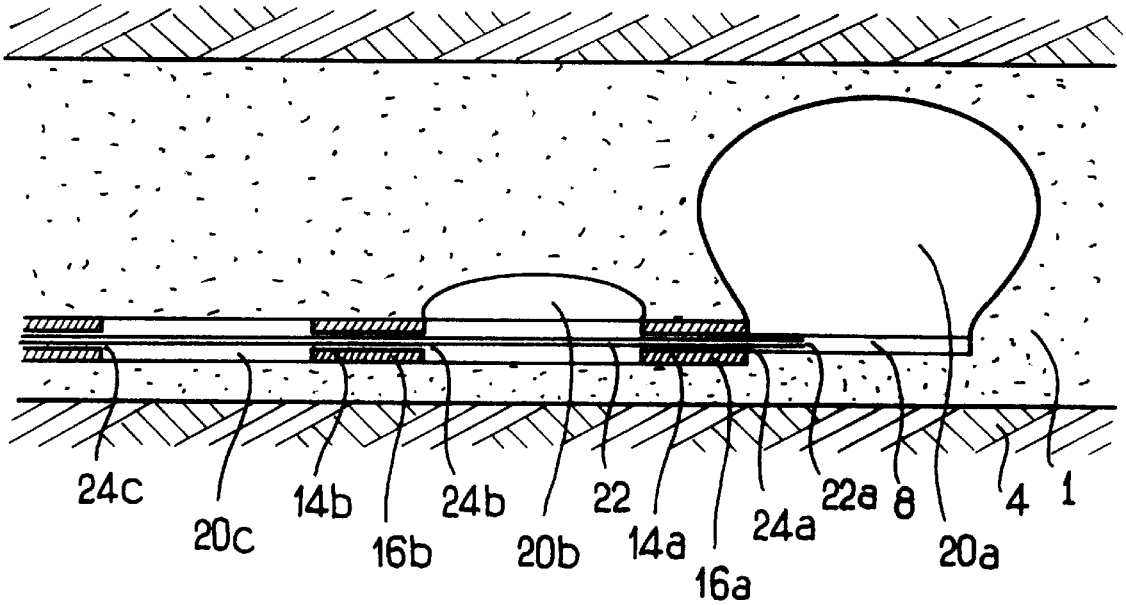
FIG. 6 is an enlarged view of the area having the reference V in FIG. 4, during a fourth step of the process and according to the first variant.

As illustrated in FIG. 6, dissolution takes place essentially in the sub-cavity 20*a* where the water is injected.

When it is judged that a sub-cavity has reached the desired size—for example by producing a mass equilibrium between the injection of water and the extraction of brine—the tube is withdrawn, so that the injection point is displaced from one sub-cavity in the direction of the last one. The dissolution operation then takes place in a similar manner to that described for the first sub-cavity.

Figure 7:
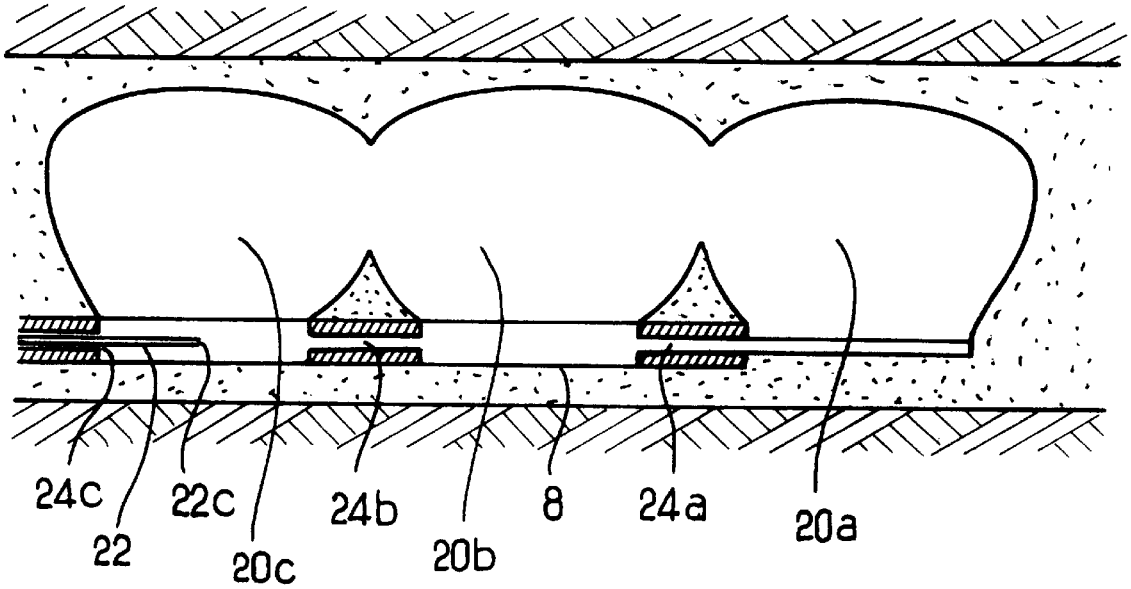
FIG. 7 is an enlarged view of the area having the reference V in FIG. 4, during a fifth step of the process and according to the first variant.

In FIG. 7, a plurality of sub-cavities 20*a*, 20*b*, 20*c* have been hollowed out by dissolution. The dissolution of each of the sub-cavities is halted before reaching the mineral layer 2 located above the layer of salt 1, in order to ensure tightness. The length of the channels 24*a*, 24*b*, 24*c*, 24*d*, 24*e* and of the preliminary cavities 20*a*, 20*b*, 20*c*, 20*d*, 20*e*, 20*f* illustrated in FIG. 4 was selected in order to permit communication between the different sub-cavities at the end of the dissolution operation. As a result, the variations in dimensions, and particularly in height, between the final cavity formed by the joining of all the sub-cavities and the layer of salt will be relatively small. In this case the length of the channels is approximately 50 meters, the length of the preliminary cavities approximately 100 meters for a layer of salt having a thickness of approximately 100 meters. The drilled hole 8 may have a diameter of the order of several centimeters, and advantageously of approximately 25 centimeters.

Figure 8:
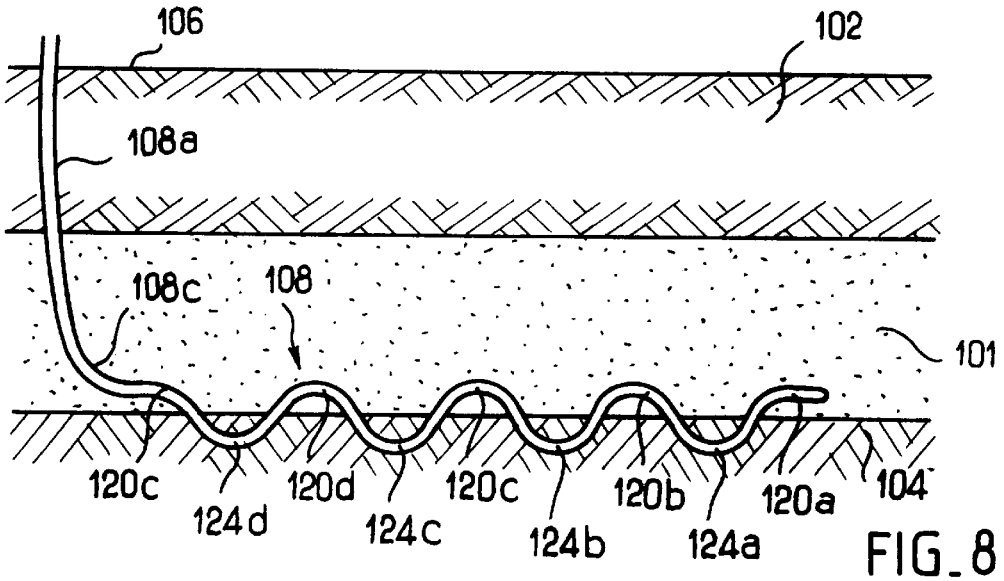
FIGS. 8 to 10 show in section a ground formation comprising a layer of salt, during three successive steps of the process and according to a second variant.
Figure 9:
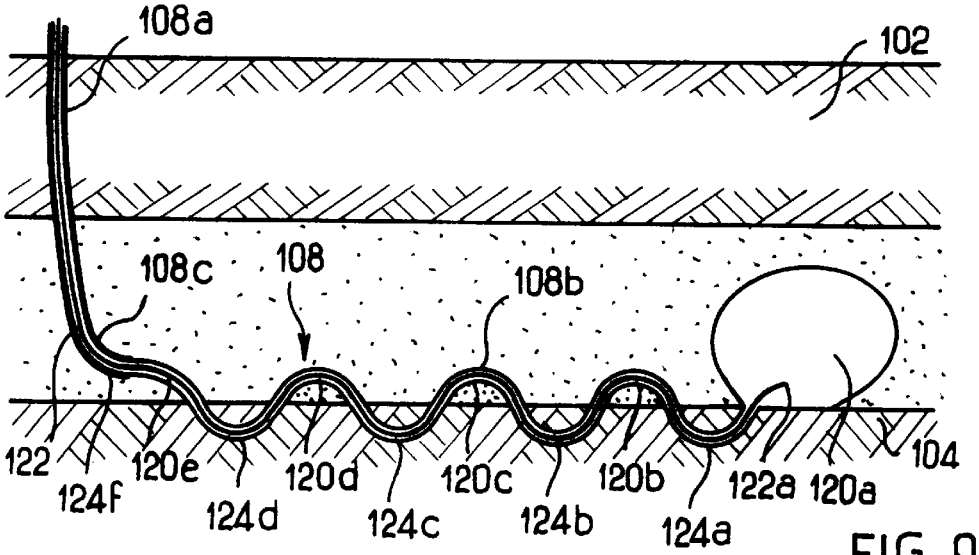
Figure 10:
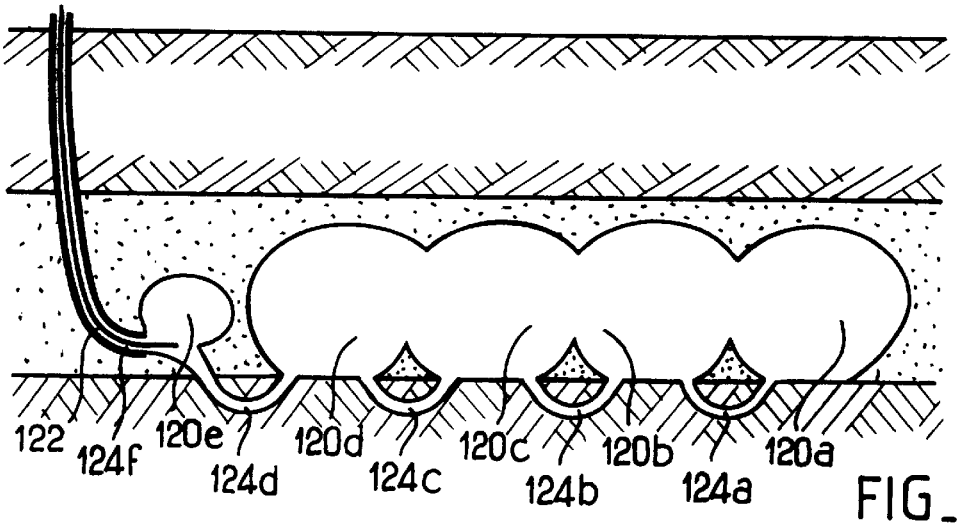

In FIGS. 8 to 10, the elements corresponding to those in FIGS. 1 to 7 have been identified by a number increased by 100 with respect to those of the preceding Figures.

In FIG. 8, the preliminary sub-cavities 120*a*, 120*b*, 120*c*, 120*d* and the channels 124*a*, 124*b*, 124*c*, 124*d* are produced directly during the drilling operation. In fact, the drilled hole 108, and more precisely the generally horizontal section 108*b*, comprises a succession of sections produced in the layer of salt 101 (which form the preliminary sub-cavities 120*a*, 120*b*, 120*c*, 120*d*) and of sections produced in the mineral layer 104 located beneath the salt layer 101 (which form the watertight connecting channels 124*a*, 124*b*, 124*c*, 124*d*, since the mineral layer 104 is assumed to be insoluble or hardly soluble in the solvent).

The hollowing out of the different sub-cavities is carried out in a manner comparable to the variant described with reference to FIGS. 1 to 7. In FIG. 9, the tube 122 has been advanced into the first sub-cavity 120*a*. The solvent is injected through the injection point 122*a* into the cavity 120*a*, dissolves the salt, then passes successively into the channels 124*a*, 124*b*, 124*c*, 124*d* and the preliminary sub-cavities 120*b*, 120*c*, 120*d*, 120*e*. The brine formed by the dissolution of the salt is extracted from the cavity 120*e* through the extraction channel 124*f*.

In FIG. 10, the last sub-cavity 120*e* is in the course of being hollowed out. It can be seen in FIG. 10 that the channels 124*a*, 124*b*, 124*c*, 124*d* serve a similar purpose to that of the channels 24*a*, 24*b*, 24*c*, 24*d*, 24*e* of FIGS. 4 to 7 by isolating the water from the layer of salt.

Although six and five sub-cavities, respectively, have been shown for each of the variants, the solution described does not appear to have any limitation as to the number of sub-cavities.

The invention is not of course limited in any way to the embodiments described above. Thus, it would be possible to replace the casing 14 of FIGS. 2 to 7 by a casing having radial openings in specific areas, and not to arrange the sealing material on these radial openings in order to produce the preliminary sub-cavities.

It would also be possible to produce a drilled hole comprising two vertical parts connected by a horizontal part, one of the vertical parts serving for the injection of water and the other part for the extraction of brine.

It would also be possible to extract the brine directly in the sub-cavity where the solvent is injected, for example by replacing the injection tube by a double casing having two channels, and by arranging one end of these channels in substantially spaced apart areas of the same sub-cavity. The water would then be injected through one channel and the brine extracted through the other channel.

This solution could be further completed by arranging double casings in different cavities at the same time.

We claim:

1. Process for hollowing out a cavity, by dissolution, in a ground formation comprising at least one layer containing predominantly salt, the process comprising the following steps:

drilling at least one hole comprising a substantially horizontal section arranged at least in part in the salt layer, providing in the drilled hole(s) an injection pipe, an extraction pipe and a preliminary communication space connecting the injection pipe and the extraction pipe, injecting a solvent of the salt, into the communication space, through one end of the injection pipe forming an injection point, extracting, through the extraction pipe, the brine formed by the dissolution of the salt, in contact with the solvent, producing a plurality of preliminary sub-cavities in the salt layer, and producing a succession of channels, isolated from the layer, the succession of channels connecting the plurality of preliminary sub-cavities in a fluid manner two at a time in order to form an open circuit for circulation of the solvent, extending between a first sub-cavity and a last sub-cavity, the preliminary sub-cavities and the channels defining the preliminary communication space.

2. Process according to claim 1, wherein the last sub-cavity is connected to the extraction pipe, and the solvent is injected successively into each of the sub-cavities.

3. Process according to claim 2, wherein:

the injection pipe and the extraction pipe are arranged concentrically, the extraction pipe being positioned round the injection pipe, the injection pipe is advanced into the succession of sub-cavities and channels until its injection point is arranged in the first sub-cavity in order to dissolve the salt principally in that cavity;

the first sub-cavity is hollowed out by injecting the solvent through the injection point, the brine circulating in the other sub-cavities and in the channels to the extraction pipe, the injection point is withdrawn into each of the sub-cavities in succession, in the direction of the last sub-cavity, and each of the sub-cavities is hollowed out by injecting the solvent into that sub-cavity, the brine circulating in the sub-cavities and the channels arranged between that sub-cavity and the last sub-cavity.

4. Process according to claim 1, wherein the channels isolated from the layer containing the salt to be dissolved are produced by arranging, in the drilled hole, casing sections impermeable to the solvent and by guiding the brine in these casing sections.

5. Process according to claim 4, wherein the communication space is produced by:

drilling the hole, introducing a casing into the drilled hole thus obtained, into the layer of salt, arranging a sealing material between the casing and the drilled hole, and eliminating the casing and the sealing material in specific areas in order to form the preliminary sub-cavities.

6. Process according to claim 1, wherein the channels isolated from the salt are produced by drilling in a ground formation adjacent to the said layer of salt and containing little or no salt soluble by the solvent.

7. A process for hollowing out a cavity by dissolution in a ground formation comprising a layer containing predominantly salt, in a bore hole having a casing and a substantially horizontal section, the process comprising the steps of:

injecting a sealing material around the casing to seal the casing into the salt layer, producing a preliminary communication space at a bottom end of the casing for solvent injection and extraction, removing the casing and the sealing material at a plurality of locations to form a plurality of preliminary sub-cavities, the plurality of preliminary sub-cavities being connected by remaining portions of the casing, injecting a solvent into each preliminary sub-cavity to form a sub-cavity, wherein a plurality of sub-cavities so formed open into each other to form the cavity.

8. The process according to claim 7, wherein the solvent is injected successively into each preliminary sub-cavity of the plurality of preliminary sub-cavities.

9. The process according to claim 7, wherein a saturated solvent is extracted from a sub-cavity nearest to a top of the bore hole.

10. The process according to claim 7, wherein the solvent is first injected into a preliminary sub-cavity farthest from a top of the bore hole.

* * * * *